US007301434B1

(12) United States Patent
Pisuk et al.

(10) Patent No.: US 7,301,434 B1
(45) Date of Patent: Nov. 27, 2007

(54) THERMALLY RESPONSIVE ELECTRICAL SWITCH

(75) Inventors: Michelle Pisuk, Waltham, MA (US); Brian Leary, Woonsocket, RI (US); Savithri Subramanyam, Sharon, MA (US); Keith E. Crowe, Littleton, MA (US); Sameer Masurkar, Attleboro, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 0 days.

(21) Appl. No.: 11/383,083

(22) Filed: May 12, 2006

(51) Int. Cl.

| | |
|---|---|
| ***H01H 61/08*** | (2006.01) |
| ***H01H 71/00*** | (2006.01) |
| ***H01H 71/08*** | (2006.01) |
| ***H01H 37/52*** | (2006.01) |
| ***H01H 37/12*** | (2006.01) |
| ***H01H 37/04*** | (2006.01) |
| ***H01H 37/14*** | (2006.01) |

(52) U.S. Cl. ..... 337/368; 337/377; 337/380; 337/372; 337/334; 337/333; 337/113; 337/107; 337/94

(58) Field of Classification Search ..... 337/368, 337/372, 107, 380, 360, 347, 94, 82, 57, 337/112–113, 100, 102, 89, 365, 377, 104, 337/111, 362

See application file for complete search history.

(56) References Cited

U.S. PATENT DOCUMENTS

| | | | | |
|---|---|---|---|---|
| 3,902,149 | A * | 8/1975 | Senor | 337/110 |
| 3,959,762 | A | 5/1976 | Senor | |
| 4,015,229 | A * | 3/1977 | Senor et al. | 337/107 |
| 4,041,432 | A * | 8/1977 | Yarworth et al. | 337/111 |
| 4,167,721 | A | 9/1979 | Senor et al. | |
| 4,220,938 | A * | 9/1980 | Grable | 337/89 |
| 4,860,435 | A * | 8/1989 | Powell | 29/622 |
| 5,015,985 | A | 5/1991 | Ubukata et al. | |
| 6,005,471 | A * | 12/1999 | Higashikata et al. | 337/347 |
| 6,674,620 | B2 * | 1/2004 | Lamborghini et al. | 361/26 |
| 6,756,876 | B2 * | 6/2004 | Sullivan et al. | 337/111 |
| 7,075,403 | B2 * | 7/2006 | Unno et al. | 337/365 |

FOREIGN PATENT DOCUMENTS

| | | | |
|---|---|---|---|
| EP | 676786 | A2 * | 10/1995 |
| JP | 05128948 | A * | 5/1993 |

* cited by examiner

*Primary Examiner*—Anatoly Vortman
*Assistant Examiner*—Bradley H Thomas
(74) *Attorney, Agent, or Firm*—Russell E. Baumann

(57) ABSTRACT

A motor protector (10) is shown having an elongated generally cup-shaped metallic housing (12) formed by a top wall (12*a*) and a side wall (12*b*) extending down from the perimeter of the top walls, the free end of which is welded to a header (14). The side and top wall have a rounded junction (12*c*) and a calibration rill (12*e*) is formed in the top wall from one end of the housing and through the rounded junction. An elongated thermostatic disc (16) is mounted in the housing and has a movable electrical contact (20) mounted at one end to be movable into and out of engagement with a stationary electrical contact (34) that is in turn mounted on a heater (26). A ceramic insulator plate (32) is interposed between the heater and the header.

17 Claims, 4 Drawing Sheets

THERMALLY RESPONSIVE ELECTRICAL SWITCH

FIELD OF THE INVENTION

This invention relates generally to thermally responsive electrical switches and more particularly to small single phase hermetic motor protector switches for use inside air conditioning and refrigeration compressors.

BACKGROUND OF THE INVENTION

It is known to provide thermally responsive switches for making and breaking an electrical circuit by moving an electrical contact into and out of engagement with a stationary electrical contact in response to selected changes in the temperature of the thermostatic disc caused by heating and cooling of the disc. Such switches have been placed in enclosed compressor housings in air conditioning and refrigeration systems and arranged to protect the motor and system components therein against over heating and over current conditions. An example of a thermally responsive switch of this type is shown in U.S. Pat. No. 3,959,762 that shows a one pin protector in which a fully formed thermostatic disc is attached at a first end to a heater by means of a welded slug. A movable contact is mounted on the second opposite end of the disc and is arranged to move into and out of engagement with a stationary contact mounted on the single pin that extends into the switch chamber of the switch. The device is calibrated by deforming the top of the housing against the first end of the disc. A limitation of this type of protector having a fully formed disc is that cycle life is limited due to stress failure that occurs in the disc in front of the slug. Further, the size of the movable contact is limited in such a device in order to minimize adverse effects on the operational characteristics of the formed disc, i.e., temperature settings, thereby limiting the current capability of the protector.

Another example of a thermally responsive switch of this type is U.S. Pat. No. 5,015,985. This patent shows a device having two terminal pins, one pin connected to an electrical resistance heater and a dome shaped housing, the other pin connected to a stationary contact. An oval or rectangular, fully formed thermally responsive snap acting element has one end welded to a metal support plate that is in turn welded to the metal housing and the other end of the snap acting element has a contact welded thereto and movable into and out of engagement with the stationary contact. As in the U.S. Pat. No. 3,959,762 patent referenced above, the disc is calibrated by deforming the housing at the location of the fixed end of the disc.

SUMMARY OF THE INVENTION

It is an object of the present invention to provide a motor protector having an envelope that is reduced in size yet has enhanced current capability and life expectancy. Another object of the invention is the provision of a thermally responsive switch useful as a motor protector in air conditioning and refrigerator systems particularly subjected to line voltage variations. Yet another object of the invention is the provision of a motor protector that overcomes the above discussed prior art limitations.

Briefly, in accordance with the preferred embodiment of the invention, a motor protector comprises a thermostatic disc having a dished ring shaped deformation in the central portion of the disc to provide snap action and is mounted at one end to a calibration rill formed in the top wall of a metal housing of the motor protector. A calibration ridge is formed at the longitudinal end of the rill and is aligned with the ring shaped deformation. The calibration rill extends through a rounded surface and has sloped walls extending downwardly to a relatively narrow, rigid flat bottom surface. A movable electrical contact mounted on the opposite end of the disc is movable into and out of engagement with a stationary electric contact. The protector has a header formed as a metal plate with an aperture defined therethrough that receives a terminal pin electrically isolated from the header by electric insulating material, preferably glass. A heater has a first segment attached to the terminal pin within the switch chamber that is generally aligned with the dished ring shaped deformation area of the disc and extends in a direction generally parallel to a plane in which the header lies and continues in a second segment that is bent toward the header to a third segment that is bent back to extend in a direction generally parallel to the plane in which the header lies. A ceramic insulator plate is attached to the top surface of the header plate within the switch chamber and disposed between the heater and the header. The stationary electric contact is mounted on the third segment of the heater and sits flat on the ceramic insulator plate. The protector is hermetically sealed by welding the free end of the housing side wall to the header with a selected gas mixture and pressure within the switch chamber.

The motor protector is calibrated by deforming the rigid flat bottom surface of the calibration rill rotationally pivoting the mount of the disc and moving the calibration ridge at the longitudinal end of the rill and disposed over the ring shaped dished portion of the disc against the deformed portion of the disc with the contacts in the engaged position. According to a feature of the invention, an electrical and thermal insulating layer is positioned between the calibration rill and the deformed portion of the disc to protect the ring shaped dished portion of the disc and to extend the off time of the disc.

BRIEF DESCRIPTION OF THE DRAWINGS

The accompanying drawings, which are incorporated in and constitute part of the specification, illustrate a preferred embodiment of the invention and, together with the description, serve to explain the objects, advantages and principles of the invention. Dimensions of certain of the parts may have been altered for the purpose of illustration and orientations mentioned in the specification and claims refer to the drawings as shown. In the drawings:

DETAILED DESCRIPTION OF PREFERRED EMBODIMENT

Figure 1:
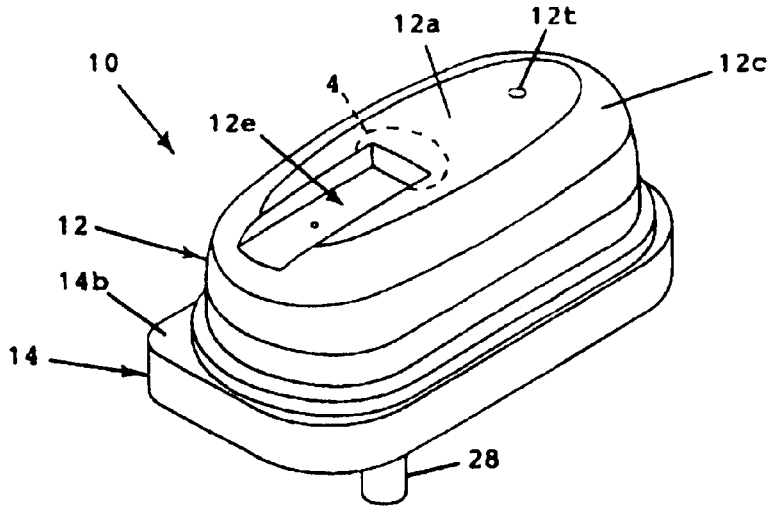
FIG. 1 is a perspective view of a single phase motor protector made in accordance with the preferred embodiment of the invention.
Figure 2:
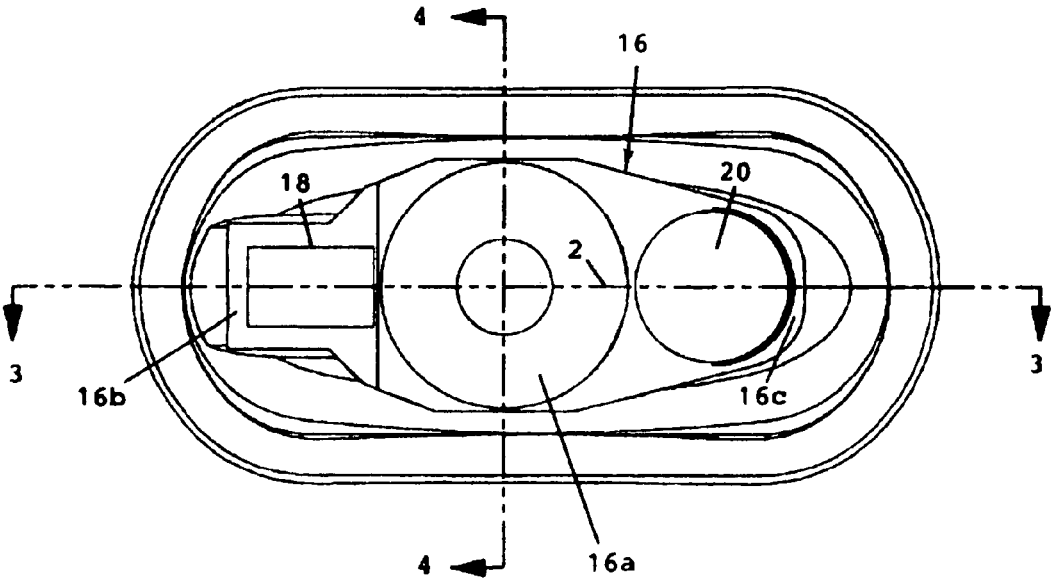
FIG. 2 is a bottom plan view of a first main assembly of the protector comprising the housing of the FIG. 1 protector and a thermostatic disc and associated components mounted therein.
Figure 3:
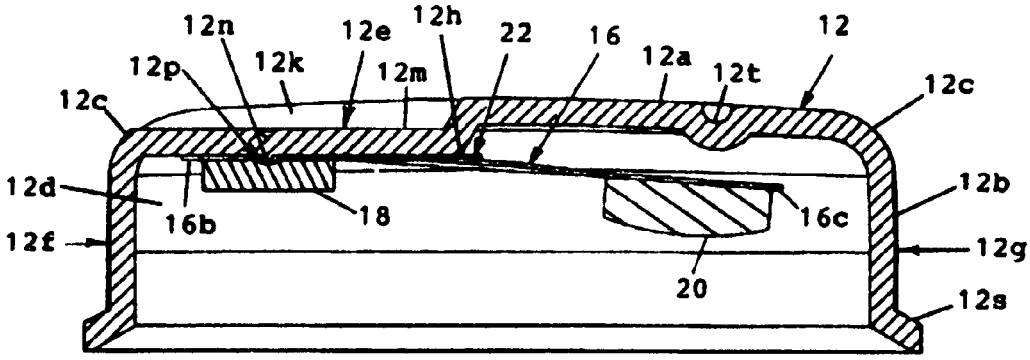
FIG. 3 is a cross sectional view taken on line 3-3 of FIG. 2.
Figure 4:
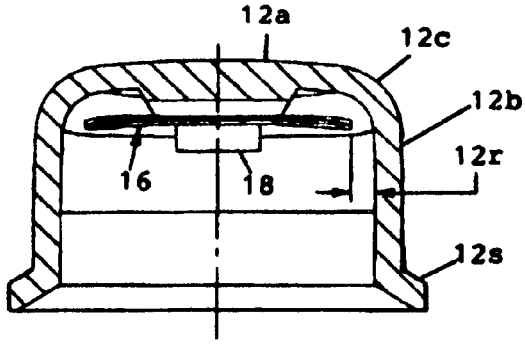
FIG. 4 is a cross sectional view taken on line 4-4 of FIG. 2.
Figure 5:
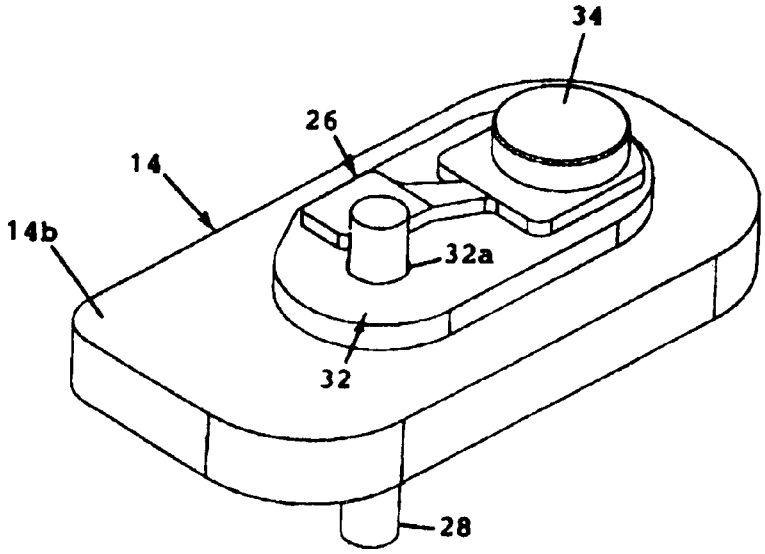
FIG. 5 is a perspective view looking down at a second main assembly comprising a header, a ceramic insulator plate, a heater, a stationary electrical contact and a terminal pin.
Figure 6:
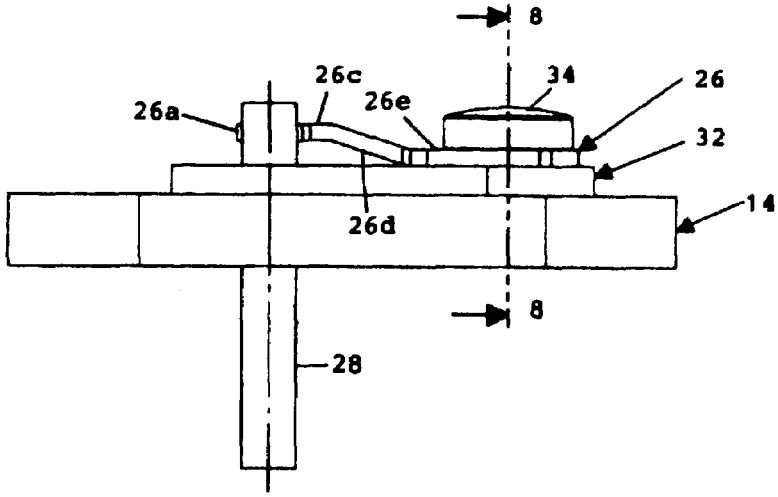
FIG. 6 is a front elevational view of the FIG. 5 assembly.
Figure 7:
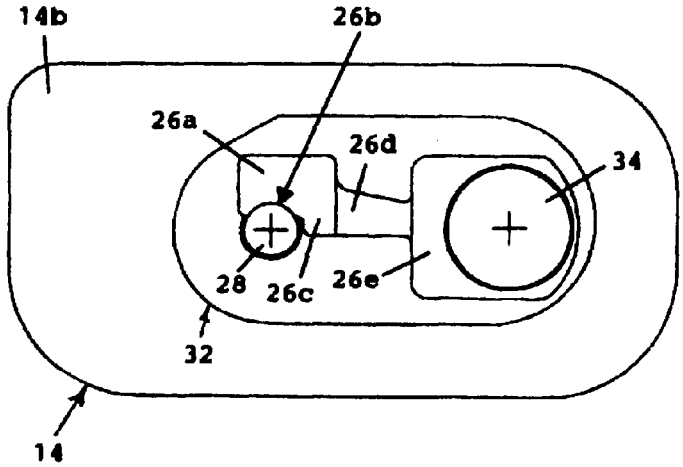
FIG. 7 is a top plan view of the FIG. 6 structure.
Figure 8:
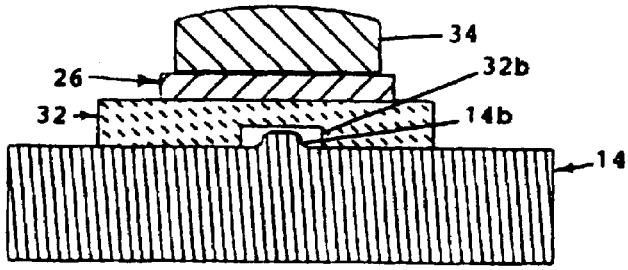
FIG. 8 is a cross sectional view taken on lines 8-8 of FIG. 6.

FIG. 1 shows a perspective view of a hermetic, single phase motor protector 10 made in accordance with the preferred embodiment of the invention comprising a first main assembly of a thermostatic disc 16 and associated components mounted on housing 12 and shown in FIGS. 2-4 and a second main assembly of a header 14, insulating plate 32, heater 26 and terminal pin 28 shown in FIGS. 5-8.

With respect to FIGS. 2-4, housing 12 of the first main assembly is made of suitable electrically conductive metal such as steel drawn into an elongated cup shaped configuration having a top wall 12*a*, a side wall 12*b* extending downwardly around the periphery of the top wall and joined thereto by a rounded junction 12*c*, the walls forming a switch chamber 12*d*. Housing 12 preferably is suitably coated for corrosion resistance.

A channel shaped calibration rill 12*e* is formed, as by stamping, into top wall 12*a* that extends along longitudinal axis 2 of the housing from a first housing end 12*f* to a calibration ridge 12*h* intermediate to housing ends 12*f* and 12*g*. Calibration rill 12*e* is formed through rounded junction 12*c* at housing side 12*f* and has side walls 12*k* angled down to a flat bottom wall 12*m* that is rigid due to the generally narrow width of wall 12*m* and particularly the angled side walls. A weld projection 12*n* is formed in calibration rill along the longitudinal axis generally midway between side 12*f* and calibration ridge 12*h* that extends downwardly into the switch chamber for welding attachment of thermostatic disc 16 to be discussed.

Elongated thermostatic disc 16 of suitable material, such as bimetal, has a weld slug 18 of suitable material, such as steel, at one end 16*b* of the disc and a movable electrical contact 20 having a highly electrically conductive facing, such as a silver alloy face, mounted on the same side of disc 16 at the opposite end 16*c*. Disc 16 is placed along the inside of top wall 12*a* and end 16*b* is welded to weld projection 12*n* of the calibration rill as shown at 12*p*, weld slug 18 and calibration rill 12*e* sandwiching the disc so that the disc lies in a plane generally parallel to the plane in which flat bottom wall 12*m* of calibration rill 12*e* lies. Top wall 12*a* may be formed with a downwardly extending dimple 12*t* to serve as a positive stop for the disc. As seen in FIG. 4, a selected clearance 12*r* is provided between disc 16 and the front and back side wall 12*b*.

A ring shaped dished deformation 16*a* is formed in thermostatic disc 16 generally in the center thereof to impart snap action between oppositely dished configurations in response to selected temperature conditions leaving opposite ends 16*b*, 16*c* unformed.

A layer 22 of electrically and preferably thermally insulating material, such as Kapton, is disposed on the inside surface of calibration rill 12*e* along the deformed portion of the disc up to and preferably slightly beyond the calibration ridge 12*h*. Insulation layer 22 electrically insulates housing 12 from the deformed portion 16*a* during assembly welding in order to prevent any adverse effect on the deformed area of the disc which could cause changes in the temperature settings of the disc. Further more, layer 22 thermally insulates the formed area of disc 16 from housing 12 during operation of the motor protector thereby increasing the off time of the protector so that the protector does not cycle too rapidly in an application.

Calibration ridge 12*h* is aligned with ring deformation 16*a* and preferably is offset slightly short of the center of the ring deformation for optimum disc performance in the protector providing proper snap distance of the disc and proper close snap spacing between the electrical contacts. Optimization of these disc functions extends the life of the protector.

The second main assembly, FIGS. 5-8, include header 14 comprising a plate of suitable material, such as steel, formed with an aperture 14*a* therethrough for reception of a copper cored terminal pin 28. Pin 28 is electrically isolated from header 14 by electrically insulative material, such as an annulus 30 of sealing glass. A flat electrical insulator plate 32, preferably of ceramic material, is disposed on header 14 and attached thereto, as with suitable epoxy. Insulator plate 32 is formed with an aperture 32*a* with terminal pin 28 protruding through the aperture. Header 14 may be formed with a guide protrusion 14*b* for receipt in a guide recess 32*b* formed in the bottom surface of insulator plate 32. Aperture 32*a* of the insulator plate is preferably expanded on the face surface of the plate received on header 14 around pin 28, as shown at 32*c* in FIG. 9, to allow for the meniscus of glass annulus 30 so that the plate will lie evenly on the top surface of the header.

Figure 9:
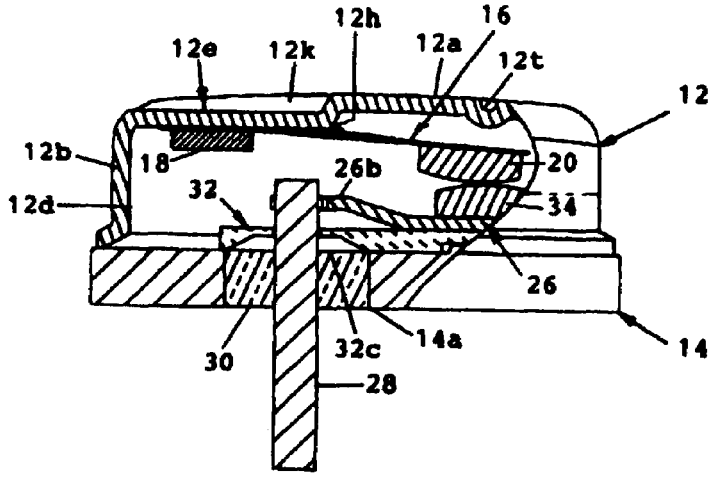
FIG. 9 is a front elevational view of the FIG. 1 motor protector, with a broken away portion in cross section.

Heater 26 is made up of a choice of different materials selected on the basis of specific applications for which the motor protector is to be used. Heater 26 has a first end 26*a* formed with a pin circumference conforming configuration 26*b* to serve as a location feature. The heater extends from end 26*a* along a first segment 26*c* in a direction lying in a plane generally parallel to a plane in which header 14 lies and continues in a second segment 26*d* bent to extend toward header 14 to a third segment 26*e* which is bent to extend in a plane generally parallel to the plane in which header 14 lies. A suitable electrical contact, such as a silver based alloy contact 34 is mounted on the third segment 26*e*, as by welding with the stepped profile allowing contact 34 to sit flat on the face of insulator plate 32 while maintaining segment 26*c* in close optimum radiant heat transfer relation to disc 16, as seen in FIG. 9. The stepped up portion, segment 26*c*, can be tailored to different dimensions to affect the amount of radiant heating, depending on the application. End 26*a* of the heater is then welded to the side of terminal pin 28 protruding out beyond ceramic insulator plate 32 with the contact on third segment 26*e* sitting flat on the insulator plate.

If desired, header 14 can be formed with an orientation feature to facilitate assembly and handling, as by generally squaring off a corner 14*b* of the header as shown, for example, in FIG. 1.

Figure 10:
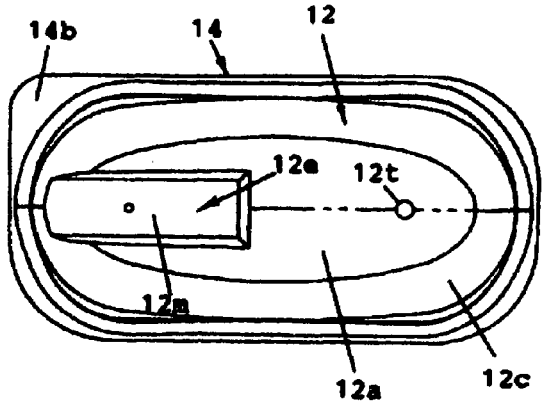
FIG. 10 is a top plan view of the FIG. 1 motor protector.
Figure 11:
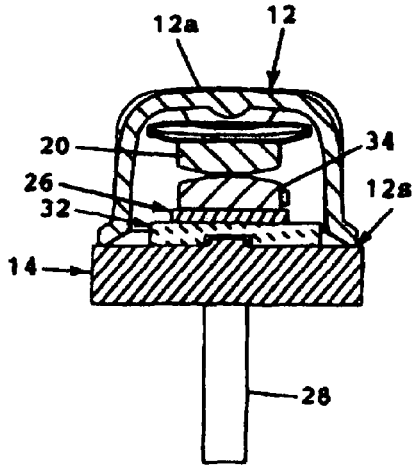
FIG. 11 is a cross sectional view looking from the right side of the FIG. 9 motor protector taken through the electrical contacts.

With reference to FIGS. 9-11, housing 12, whose side wall 12*b* is preferably flared at the free end 12*s* thereof to facilitate welding, is placed on header plate 14 such that contacts 20, 34 mate. The assembly is welded around the perimeter of the housing forming, along with glass annulus 30, a hermetic seal inside switch chamber 12*d*. The internal atmosphere in the switch chamber is controlled for both gas mixture and pressure to optimize performance of the motor protector.

Motor protector 10 is calibrated to a specific operating temperature by rotationally deflecting calibration rill 12*e*, as by deforming the housing with a probe at the longitudinal end of the rill, as shown by dashed line 4 of FIG. 1. This changes the angle in which flat bottom wall 12*m* lies and in turn, the disc assembly, that is, the disc mount, through deformation of the rigid flat bottom wall 12*m* of the calibration rill 12*e*, so that the angle of the plane in which the rigid flat bottom wall 12*m* lies is changed, the flat wall in effect rotating about rounded portion 12*c* at end 12*f* of the housing. It should be noted that the entire length of the flat wall 12*m* is deformed angularly, without changing the flatness of wall 12*m*, in order to provide the desired protector function. Calibration is effected by deforming the housing with a probe engaging the housing along dashed line 4 and deforming the housing at the longitudinal end of calibration rill 12*e* in a localized area that includes calibration ridge 12*h*.

Among the advantages provided by the invention, the single pin configuration allows for a smaller overall device size than a two pin configuration. The ring form disc, as used in the invention with calibration ridge 12*h* applying a force to the ring shaped deformed area 16*a* of the disc through insulation layer 22, has the advantage of increased cycle life due to reduced stress in the disc because calibration occurs at the center of the disc rather than pivoting about a slug. Due to the ring form, a larger electrical contact can be mounted on the unformed end of the disc without adversely effecting the temperature settings of the deformed area of the disc thereby allowing the possibility of increased current capacity within a small device envelope. This type of disc and calibration method also provides excellent temperature stability over life. The heater and disc configuration allows for quicker trip time at low currents in comparison to prior art devices in which the disc is connected electrically to the heater and terminal pin. Quicker trip times at lower currents are particularly advantageous for applications which require protection at lower currents due to line voltage fluctuations.

It will be understood that although a particular preferred embodiment of the motor protector has been described by way of illustrating the invention, modifications of structure could be made within the scope of the invention. The invention includes all modifications and equivalents of the illustrated embodiment that fall within the scope of the amended claims.

What is claimed is:

1. A single phase motor protector comprising:

a generally cup shaped metallic housing being elongated along a longitudinal axis from first to second opposite ends and having a closed top wall, a side wall having a free end extending around the circumference of the top wall and forming a rounded junction therewith, the top and side walls forming a switch chamber, a calibration rill having a rigid flat bottom surface formed in the top wall extending from the first end through the rounded junction to a calibration ridge along the longitudinal axis, a weld projection formed on the calibration rill intermediate to the first end of the metallic housing and the calibration ridge extending into the switch chamber, the rigid flat bottom surface as a whole being deformable to change the angle of a first plane in which the rigid flat bottom surface lies, an elongated thermostatic disc having first and second ends disposed along the longitudinal axis, the first end of the thermostatic disc welded to the calibration rill at the weld projection and generally lying in a plane parallel to the first plane, the thermostatic disc having a ring shaped deformation in a central portion of the thermostatic disc, the ring shaped deformation being movable between oppositely dished configurations in response to selected changes in temperature, a movable electrical contact mounted on the thermostatic disc at the second end thereof, the thermostatic disc being positioned along the longitudinal axis so that the calibration ridge is aligned with the ring shaped deformation, an electrically conductive header plate received on the free end of the side wall and hermetically attached thereto, a terminal pin extending through an aperture in the electrically conductive header plate into the switch chamber, the terminal pin electrically separated from the electrically conductive header plate by an electrical insulating material, an electrically conductive heater electrically connected to the terminal pin, and a stationary electrical contact mounted on the electrically conductive heater with the movable electrical contact adapted to move into and out of engagement with the stationary electrical contact.

2. A single phase motor protector according to claim 1 in which the ring shaped deformation has a center and the calibration ridge is offset in the direction of the first end of the metallic housing from the center of the ring shaped deformation by a selected distance.

3. A single phase motor protector according to claim 1 further comprising a layer of electrical and thermal insulating material interposed between the calibration rill and the deformed central portion of the thermostatic disc.

4. A single phase motor protector according to claim 1 in which the electrically conductive heater has a first end attached to the terminal pin and extends for a first segment generally parallel to a second plane in which the header plate lies, a second segment of the electrically conductive heater is bent toward the header plate at the end of the first segment and continues on to a third segment bent to extend generally parallel to the second plane, the stationary electrical contact being mounted on the third segment.

5. A single phase motor protector according to claim 4 further comprising an electrical insulator plate interposed between the electrically conductive heater and the header plate, the electrical insulator plate extending over the electrical insulating material around the terminal pin.

6. A single phase motor protector according to claim 5 in which the electrical insulator material around the terminal pin is formed of glass and the electrical insulator plate is formed of ceramic.

7. A single phase motor protector according to claim 6 in which the electrical insulator plate extends laterally beyond the electrically conductive heater in all directions.

8. A single phase motor protector according to claim 1 in which the calibration rill is relatively narrow and is formed with longitudinally extending side walls extending from two opposite sides of the flat bottom surface to enhance the rigidity of the flat bottom surface.

9. A single phase motor protector according to claim 1 in which the motor protector is backfilled with a selected atmosphere at a selected pressure to provide selected heat transfer characteristics.

10. A single phase motor protector comprising:

a generally cup shaped metallic housing being elongated along a longitudinal axis from first to second opposite ends and having a closed top wall, a side wall having a free end extending around the circumference of the top wall and forming a rounded junction therewith, the top and side walls forming a switch chamber, a calibration rill formed in the top wall extending from the first end to a calibration ridge along the longitudinal axis, a bottom wall of the calibration rill forming a rigid flat bottom surface lying in a first plane, a weld projection formed on the calibration rill extending into the switch chamber, an elongated thermostatic disc having first and second ends disposed along the longitudinal axis, the first end of the thermostatic disc welded to the calibration rill at the weld projection and generally lying in a plane parallel to the first plane, the thermostatic disc formed with a ring shaped dish shaped configuration in a central portion of the thermostatic disc, the thermostatic disc being movable between oppositely dished configurations in response to selected changes in temperature, a movable electrical contact mounted on the thermostatic disc at the second end thereof, an electrically conductive header plate received on the free end of the side wall and hermetically attached thereto and lying in a second plane, a terminal pin extending through an aperture in the electrically conductive header plate into the switch chamber, the terminal pin electrically separated from the electrically conductive header plate by electrical insulating material, an electrically conductive heater having a first end fixed to the terminal pin and extending for a first segment generally parallel to the second plane, a second segment of the heater bent toward the header at the end of the first segment and continuing on in a third segment bent to extend generally parallel to the second plane, a stationary electrical contact mounted on the third segment with the movable electrical contact adapted to move into and out of engagement with the stationary electrical contact, and an electrical insulator plate disposed on the header plate interposed between the heater and the electrically conductive header plate, the insulator plate covering the electrical insulating material around the terminal pin.

11. A single phase motor protector according to claim 10 further comprising a layer of electrical and thermal insulation material interposed between the calibration rill of the housing and the metallic thermostatic disc.

12. A single phase motor protector according to claim 11 in which the layer of electrical insulation material is composed of Kapton.

13. A single phase motor protector according to claim 10 in which the electrical insulating material around the terminal pin is glass and a recess is formed in the electrical insulating material aligned with and facing the glass around the terminal pin.

14. In a single phase motor protector having a generally cup shaped metallic housing elongated along a longitudinal axis from first to second opposite ends and having a closed top wall, a side wall having a free end extending around the circumference of the top wall, the method steps comprising the steps of forming a calibration rill in the top wall having longitudinally extending side walls extending down to a flat bottom surface to rigidify the flat bottom surface, the calibration rill extending from the first end of the metallic housing to a calibration ridge along the longitudinal axis, taking an elongated thermostatic disc having first and second ends, mounting the first end of the thermostatic disc to the calibration rill, the disc having a ring shaped deformation in a central portion of the thermostatic disc disposed adjacent to the calibration ridge, the thermostatic disc being movable between oppositely dished deformation configurations in response to selected changes in temperature, a movable electrical contact mounted on the thermostatic disc at the second end thereof beyond the ring shaped deformation and being movable into and out of engagement with a stationary electrical contact, calibrating the motor protector by deforming the entire flat bottom surface of the calibration rill by rotating the flat bottom surface about the first end of the metallic housing to adjust the calibration ridge relative to the ring shaped deformation thereby adjusting the performance of the thermostatic disc.

15. A method according to claim 14 in which the top and side walls of the metallic housing have a rounded junction therebetween and the calibration rill extends through the rounded junction at the first end of the metallic housing.

16. A method according to claim 14 in which the flat bottom surface of the calibration rill is rotated by applying a downward force on the metallic housing in a localized area that includes the calibration ridge.

17. A method according to claim 14 in which the ring shaped deformation has selected operational characteristics and the movable electrical contact mounted on the thermostatic disc is enlarged to increase current capability of the motor protector without adversely effecting the characteristics of the thermostatic disc.

* * * * *